United States Patent [19]

Eccardt

[11] 4,364,548

[45] Dec. 21, 1982

[54] PORTABLE WORKBENCH

[75] Inventor: Curtis J. Eccardt, St. Charles, Mo.

[73] Assignee: Emerson Electric Co., St. Louis, Mo.

[21] Appl. No.: 194,611

[22] Filed: Oct. 6, 1980

[51] Int. Cl.[3] ..... B25B 1/22

[52] U.S. Cl. ..... 269/139; 269/220; 269/244; 269/901; 248/188; 108/156; 403/349

[58] Field of Search ..... 248/188; 108/156; 403/349; 269/901, 139, 219–220, 240, 244

[56] References Cited

U.S. PATENT DOCUMENTS 3,851,601 12/1974 Davis ..... 403/349
4,231,557 11/1980 Blachly et al. ..... 269/901

FOREIGN PATENT DOCUMENTS 292665 6/1928 United Kingdom ..... 248/188
1370691 10/1974 United Kingdom ..... 248/188

*Primary Examiner*—Robert C. Watson
*Attorney, Agent, or Firm*—Polster, Polster and Lucchesi

[57] ABSTRACT

A portable workbench having a combination tabletop/-dual-screw vise in which the ends of the vise screws are connected to a movable vise jaw and in which the ends of the vise screws are constrained against both lateral and vertical movement. The workbench includes pipe legs which are readily installed in or readily removed from "twist-lock" leg sockets carried by the workbench without the necessity of utilizing any fasteners (e.g., bolts or screws) or even simple hand tools.

18 Claims, 9 Drawing Figures

PORTABLE WORKBENCH

BACKGROUND OF THE INVENTION

This invention relates to portable workbenches, and particularly to such portable workbenches which utilize their workbench tops as a double screw vise for holding a variety of workpieces including irregularly shaped workpieces.

In recent years, various portable workbenches have become popular for home use which are typically described in the U.S. Pat. Nos. 3,615,087 to Hickman, 4,061,323 to Beekenkamp, 4,199,135 to Wohrle et al., and in the co-assigned U.S. Pat. No. 4,231,557 to Blachly et al. All of these portable workbenches include a pair of horizontal tabletop, vise jaw members in which one of the tabletop members is in fixed position and the other is adjustably movable toward and away from the fixed jaw by selective operation of a pair of hand crank-operated vise screws. By turning the vise screws different amounts, the movable vise jaw may be selectively, angularly moved with respect to the fixed vise jaw and objects of irregular shape (i.e., tapered) may be readily clamped by the vise.

Of course, as is readily apparent, when the movable vise jaw is moved angularly with respect to the fixed vise jaw, it becomes necessary to compensate for a change in length between the attachment points between the movable vise jaw and the two vise screws so as to avoid binding.

In the above-noted patents to Hickman and Beekenkamp, this binding is avoided by permitting the vise screws and the movable vise jaw to move laterally a slight distance. In the above-noted Blachly et al patent, this binding movement is prevented by pin-and-slot connections between the vise screws and the movable vise jaw. These pin-and-slot connections allow both side-to-side and angular movement of the movable vise jaw with respect to the vise screws when one of the vise screws is operated (i.e., rotated) an amount different from the other vise screw.

Reference is also made to such prior art patents as Castagna, U.S. Pat. No. 1,716,718, which discloses a chuck for holding work in which both of the jaws of the chuck are movable angularly and toward and away from one another by selective operation of a pair of vise screws. Castagna utilizes a pin-and-slot connection to overcome binding when one of the jaws is moved angularly relative to the other. Thomas, U.S. Pat. No. 985,857, discloses a door sash clamp having two movable clamp bars selectively movable toward and away from one another and angularly with respect to one another by selective operation of a pair of vise screws. The vise screws are connected to the clamping bars of the apparatus by means of swivel nuts and bearings. For permitting angular positioning with respect to one another, apertures are provided in the clamp bars through which the vise screws pass, these apertures being larger than the vise screws so as to permit lateral movement between the guideway for the clamping bars and the clamping bars.

As a further example of prior art double screw vises, reference may be made to a woodworking bench which is a part of the Dominy collection from the late 18th and early 19th century on display at the Henry Francis duPont Winterthur Museum in Wilmington, Del. Still further, reference may be made to *A Museum Of Early American Tools* by Eric Sloane published by Wilford Funk, Inc. in 1974 which discloses a prior art double screw vise.

While all of the above-noted prior art double screw vises and workbenches permitted angular movement of the movable vise jaw, there has been a need to provide a connection between the vise screws and the movable vise jaw which is of simple and economical construction, which efficiently transfers load or force between the vise screws and the movable vise jaw, and yet which permits the vise screws to be easily rotated even when under load.

As mentioned above, the instant invention is a portable workbench. In the above-noted patent to Hickman, the workbench disclosed therein has foldable or collapsible legs which can be folded so as to aid in transporting and storing the workbench. However, these foldable or collapsible legs are relatively complicated and expensive to manufacture. In the above-noted Beekenkamp patent, a portable workbench is disclosed which is supported by a collapsible stand made of lightweight tubing. This stand consists of two rectangular frames which are rigidly connected together at their centers and which are pivotally movable relative to one another between a folded or closed position in which the rectangular frames are on top of one another and an open position in which the frames assume a generally X-shaped configuration when viewed from their ends. The upper sides of the frame are clipped to the frame of the workbench and the bottoms of the frames bear on the ground.

In the Blachly et al patent, the workbench is supported by means of pipe legs which are socketed in receptacles integrally cast with the workbench frame and which are positively secured to the frame by means of removable fasteners (bolts). While these pipe legs provide an extremely solid support for the workbench, they require the use of threaded fasteners to hold the legs securely in place and a die cast frame for the workbench.

As noted above, certain of the prior art portable workbenches utilize relatively complicated castings for at least some portions of the workbench frame. While these castings result in a highly rigid structure and are aesthetically appealing, they also result in relatively high manufacturing and tooling costs for the workbench.

Among the several objects and features of the present invention may be noted the provision of a portable workbench, such as described above, in which each of the vise screws is positively constrained against substantial lateral and vertical movement and yet in which the movable vise jaw is relatively free, within a limited range, to assume any angular position with respect to the fixed jaw;

The provision of such a portable workbench in which the ends of the vise screws opposite their crank handles are supported by a guide constrained against both lateral and vertical movement;

The provision of such a portable workbench in which the frame of the workbench is fabricated entirely of sheet metal or the like and which is exceedingly rigid without the necessity of using costly castings;

The provision of such a portable workbench in which the vise screws are substantially enclosed within the frame;

The provision of such a portable workbench which is solidly supported at a convenient work height by means of pipe legs which are readily removably secured to the workbench frame without the use of fasteners or without the necessity of utilizing even simple hand tools;

The provision of such a portable workbench which, with its legs removed, may be solidly clamped to a tabletop or the like;

The provision of such a portable workbench which has unobstructed entry under the workbench from all sides thereof to permit convenient use of the workbench;

The provision of such a portable workbench in which the support legs, when removed from the workbench frame, may be stored within the workbench frame; and The provision of such a portable workbench which is of lightweight but yet rigid and solid construction, which is easy and relatively inexpensive to manufacture, and which is convenient to use.

Other objects and features of this invention will be in part apparent and in part pointed out hereinafter.

SUMMARY OF THE INVENTION

Briefly stated, a portable workbench of the present invention comprises a frame, a plurality of legs supporting the frame, a pair of work holding table members (referred to as vise jaws) carried by the frame, one of the table members being fixed relative to the frame and the other table member being movable relative to the frame toward and away from the fixed member, and a pair of vise screws carried by the frame and operatively coupled to the movable table member. These vise screws are operable independently of one another thereby to selectively move the movable table member toward and away from the fixed table member and, upon rotating the vise screws different amounts, to angle the movable table member relative to the fixed table member. Specifically, the improvement of this invention relates to the above-mentioned frame which is of generally rectangular configuration including a front frame member, a back frame member, and a pair of hollow end members extending between the front and back frame members, each of the end frame members having a longitudinal slot in the upper face thereof. Each of the vise screws is disposed within a respective end frame member, is journalled relative to the front frame member, and extends out beyond the front frame member. Each of the end frame members has a guide threadably coupled with a respective vise screw and being movable axially therewithin upon rotating the vise screw, this guide having a sliding fit within its respective end frame member and being constrained against substantial vertical and lateral movement with respect to its respective end frame member. A pair of support fittings engagable with the lower face of the movable table member is provided, each of the support fittings being positioned to bear against the upper surface of a respective end frame member. A pair of elongate slots is provided in the movable end table member, each of these elongate slots being disposed generally above a respective end frame member and extending in generally lateral direction with respect to the movable table member. Means extending through the slot in the upper face of each of the end frame is provided for interconnecting the support fittings to the guides for the transfer of force from the vise screws to the movable table member. A pin is carried by each of the support fittings, these pins each being received in a respective elongate slot in the movable table member for transmitting the load between the support fitting and the movable table member substantially in the direction of the axis of the vise screw and for permitting the movable table member to move angularly with respect to the fixed table member upon operating the vise screws different amounts. Further, means secured to the movable table member and extending down through the slots in the upper faces of each of the respective end frame members is provided for holding the movable table member in a desired horizontal position.

In another embodiment of the portable workbench of this invention, the workbench has a frame, a plurality of pipe legs, a plurality of sockets carried by the frame, one socket for each pipe leg, and quick-acting twist-lock means for locking the legs in the sockets thereby to secure each of the legs to the frame and thereby to solidly support the frame and for unlocking the legs for disassembly of the workbench. Each of the above-noted sockets includes an upper bracket for receiving the upper end of its respective pipe leg and a lower bracket spaced below the upper bracket, the lower bracket having an opening therethrough for receiving the pipe leg. Each of the pipe legs has means projecting outwardly therefrom so as to engage the lower bracket when the pipe leg is inserted in its respective socket. The lower bracket is so structured as to permit the projection means on the pipe leg to be inserted in and removed from the socket. The lower socket bracket is cooperable with the projection means so that upon rotating the pipe leg relative to the socket, the projection means cammingly engages the lower bracket thereby to lock the leg in position with respect to the socket.

BRIEF DESCRIPTION OF THE DRAWINGS

Corresponding reference characters indicate corresponding parts throughout the several views of the drawings.

DESCRIPTION OF A PREFERRED EMBODIMENT

Figures 1, 6:
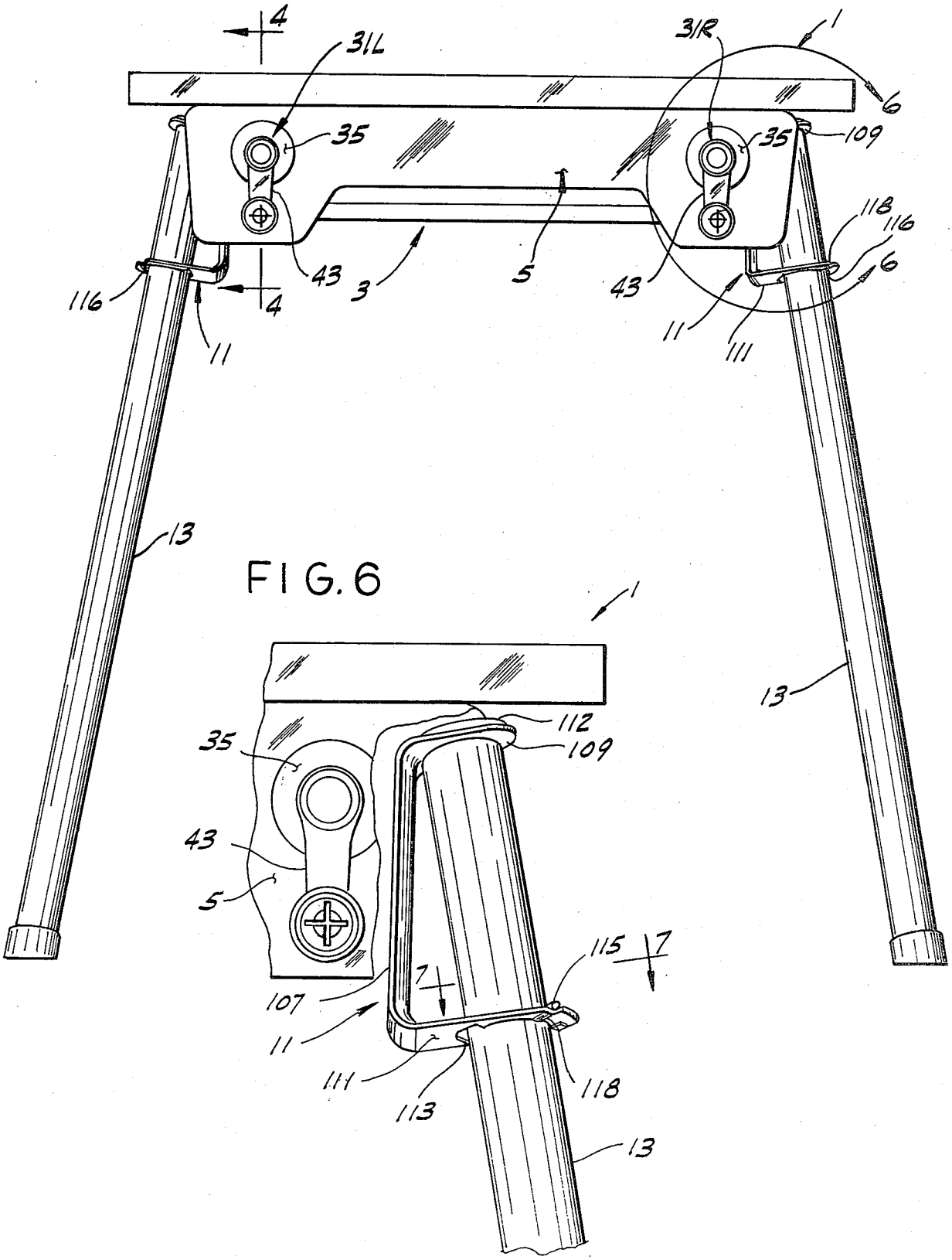
FIG. 1 is a front elevational view of a portable workbench of the present invention as it is supported on its legs which are removably secured to the workbench frame by means of "twist-lock" leg attachment sockets in accordance with this invention.
FIG. 6 is an enlarged view of a portion of FIG. 1 taken on line 6—6 illustrating how the pipe legs are socketed in the "twist-lock" leg sockets.

Referring now to the drawings, a portable workbench of the present invention is indicated in its entirety by reference character 1. The workbench is shown to comprise a frame weldment, as generally indicated at 3, comprising a front frame member 5, a rear frame member 7, and a pair of right and left hand end frame members 9R, 9L extending between the ends of the front and rear frame members. Each of the end frame members is a hollow box beam, as will be hereinafter described in greater detail, and the various frame members are welded together to form a rigid weldment. As is best illustrated in FIG. 3, the various frame members are preferably fabricated from sheet metal.

Figures 3, 7:
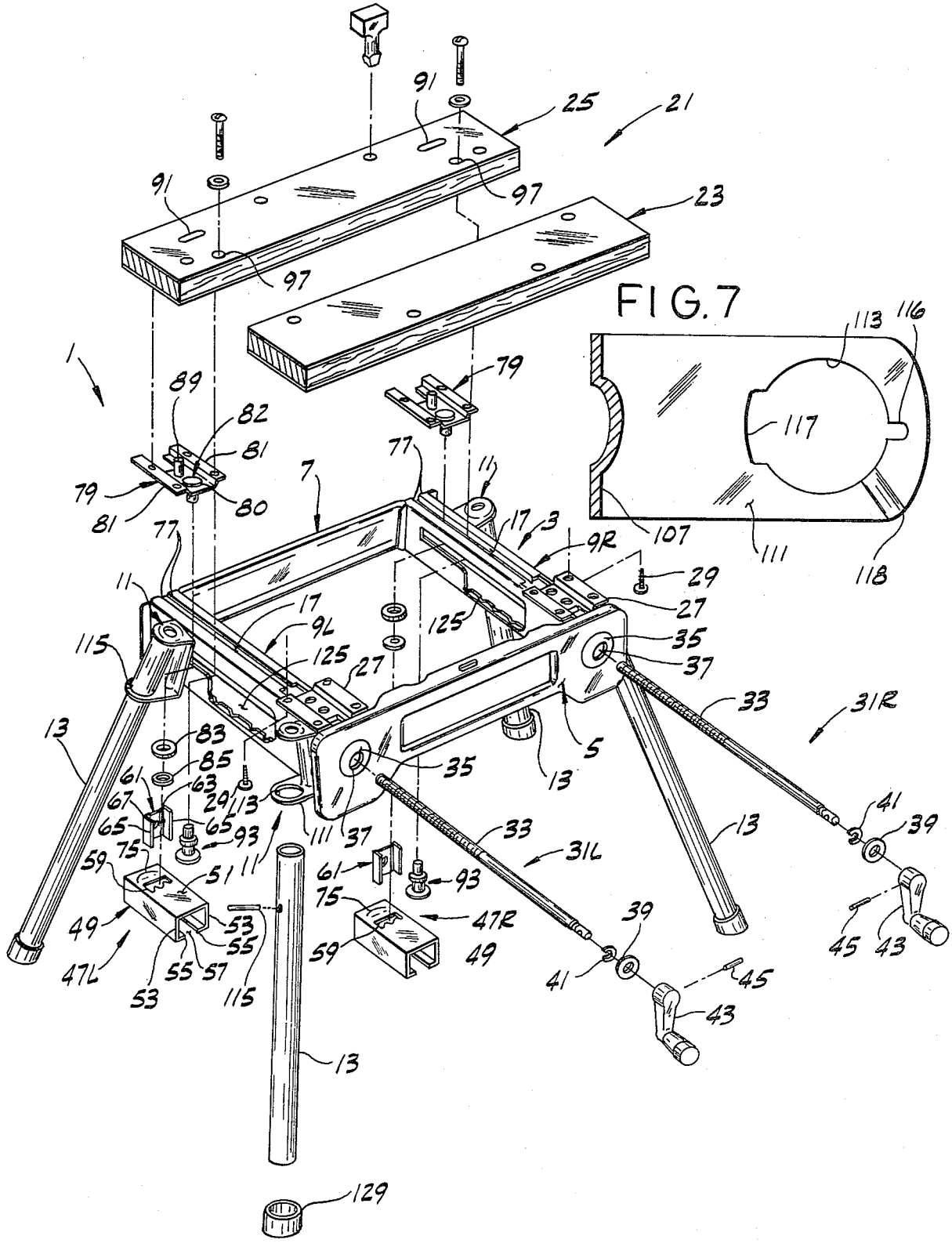
FIG. 3 is an exploded perspective view of the workbench illustrated in FIGS. 1 and 2.
FIG. 7 (sheet 3) is a top plan view of the lower flange of the leg socket, as taken along line 7—7 of FIG. 6.

Referring now to FIG. 3, a plurality (four) of leg sockets, each of which is generally indicated at 11, is rigidly secured (e.g., welded) to the outer faces of end frame members 9R and 9L for rigidly mounting respective pipe legs 13 to the frame. Thus, with pipe legs 13 securely socketed in leg sockets 11, the workbench frame 3 is rigidly supported in a convenient working height. In accordance with the objects of this invention, sockets 11 are referred to as "twist-lock" securement means for the ready insertion and removal of legs 13 from frame 3. Details of construction of the "twist-lock" leg sockets will be hereinafter set forth.

A combination workbench table top and vise arrangement, as generally indicated at 21, is mounted on top of frame 3. The table top/vise combination is comprised by a stationary vise jaw, as generally indicated at 23, rigidly mounted on top of end frame members 9R, 9L at the front of the frame, and a movable vise jaw 25 movably mounted on the end of frame members for selective movement toward and away from the stationary vise jaw for clamping and unclamping a work piece (not shown) disposed between the inner faces of the jaws. Vise jaws 23 and 25 are shown to be elongate planar members preferably fabricated from a hard-faced composition board.

Stationary vise jaw 23 is rigidly mounted with respect to end frame members 9R, 9L by means of a pair of support fittings 27 each rigidly secured to the upper face of a respective end frame member. Screws 29 inserted through appropriate screw holes in support fittings 27 engage the under face of stationary vise jaw 23 and rigidly hold the stationary vise jaw on support fittings 27.

Movable vise jaw 25 is selectively movable toward and away from stationary jaw 23 and is further selectively angularly movable with respect to the stationary vise jaws by manual operation (i.e., turning) of a pair of vise screw assemblies 31R, 31L at the right and left ends of frame 3. These vise screw assemblies are essentially identical to one another and thus only the left vise screw assembly 31L will be described in detail.

Figure 5:
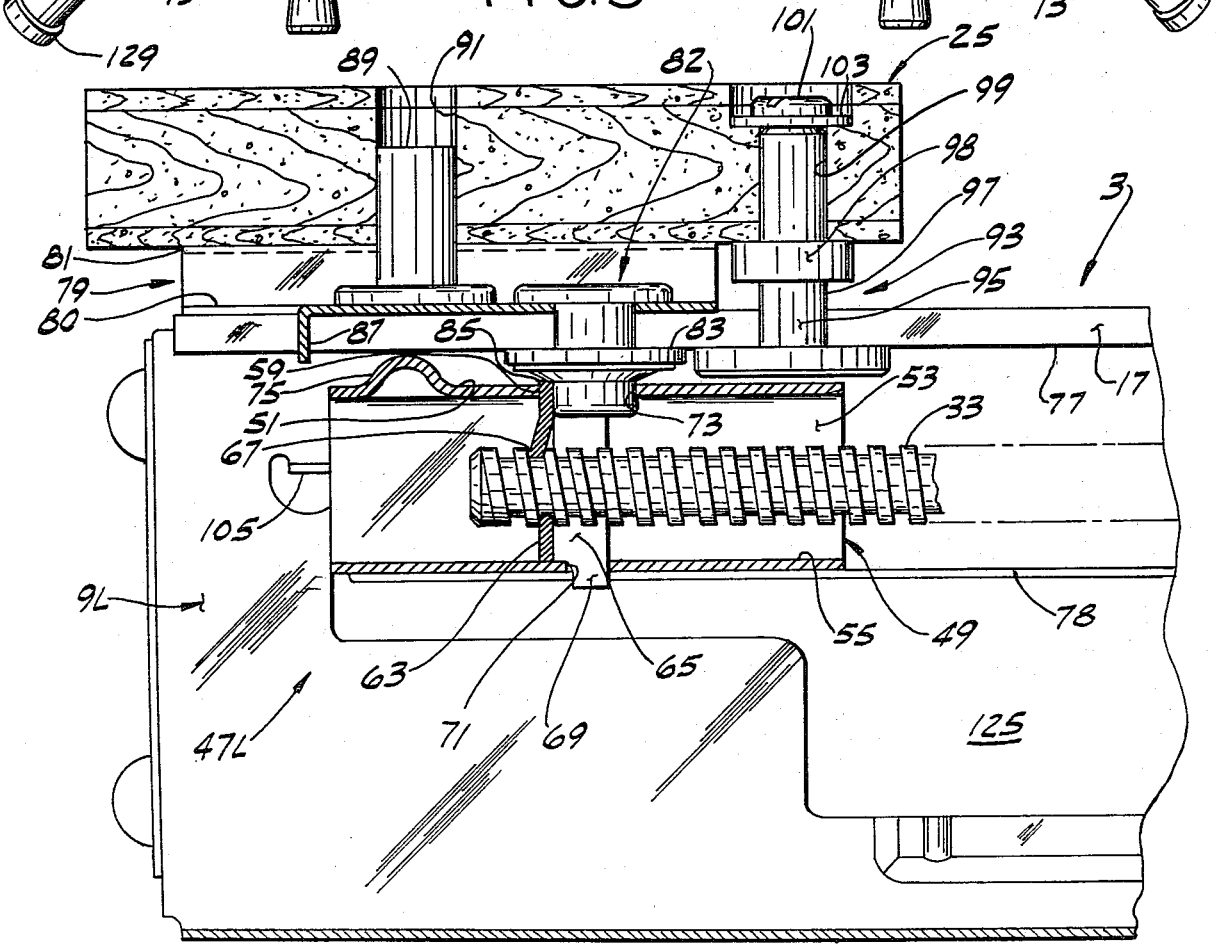
FIG. 5 is a portion of FIG. 4 on an enlarged scale illustrating in detail the manner in which the movable vise jaw is connected to its vise screw.
Figure 4:
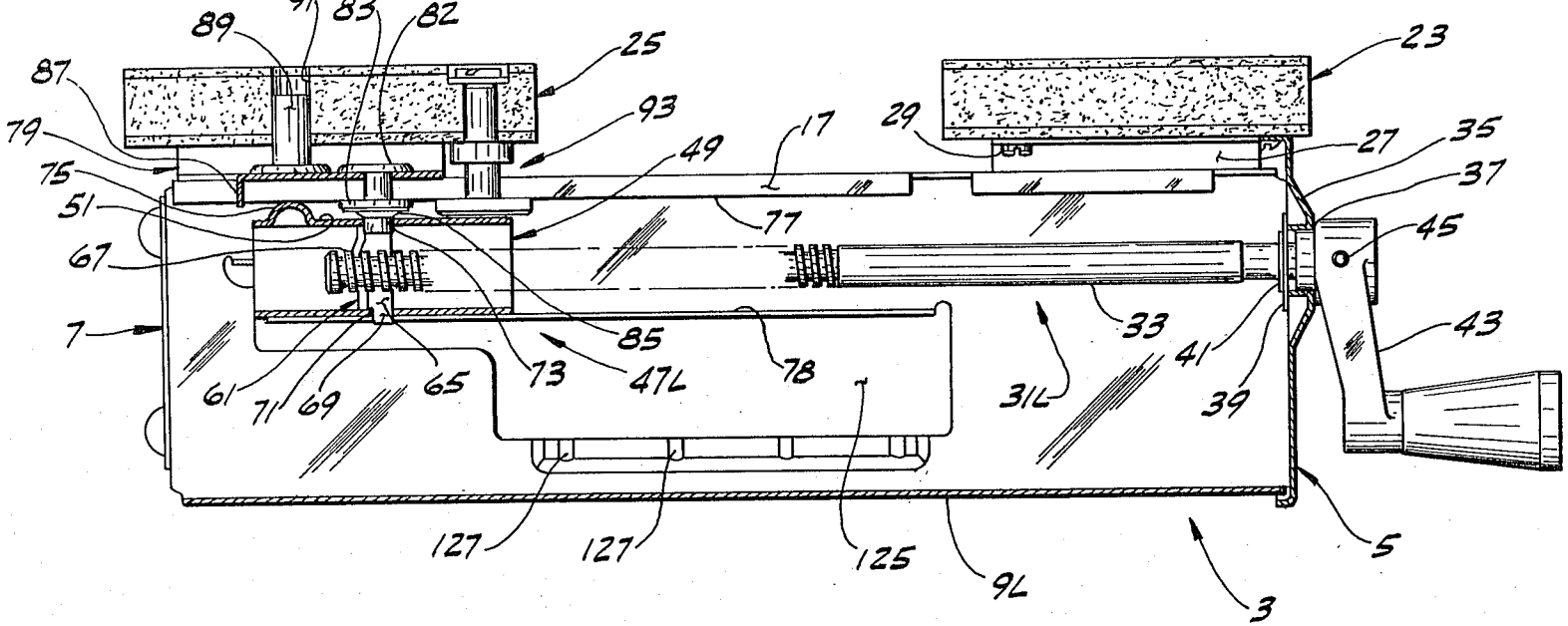
FIG. 4 is a vertical cross-sectional view taken along line 4—4 of FIG. 1 illustrating details of one of the vise screws enclosed within its end frame member.

As shown best in FIGS. 3–5, vise screw assembly 31L comprises an elongate vise screw or threaded rod 33 disposed within the left end frame member 9L. Outwardly protruding dimples 35 are provided on the front frame member 5 and the end of each vise screw 33 extends out through an aperture 37 provided in the center portion of each dimple 35. A washer 39 is provided on the end threaded rod 33 adjacent the inner face of front frame member 5 and a snap ring 41 is installed in a circumferential groove provided in the end of the threaded rod 33 thereby to hold the threaded rod in place. A crank handle 43 is pinned to the outer end of the threaded rod by means of a roll pin 45. As best shown in FIG. 4, the hub of the crank handle 43 bears against the outer face of dimple 35 and thus serves to transfer axial load from threaded rod 33 to front frame member 5.

In accordance with this invention, the inner end of each of the threaded rods 33 of vise screw assemblies of 31R and 31L is threadably engageable with a respective guide assembly, as generally indicated at 47R, 47L, for interconnection with movable jaw 25, and for constraining or caging the outer end of threaded rod against both lateral (i.e., horizontal side-to-side) and vertical movement whereby the guide assembly is caused to move substantially axially with respect to the threaded rod upon rotation thereof. Since each of the guide assemblies 47R, 47L is substantially identical, only guide assembly 47L is described in detail.

As shown best in FIGS. 3 and 5, guide assembly 47L comprises a guide member 49 which is essentially a length of rectangular cross-section tubing having an upper face 51, side flanges 53 extending downwardly from the upper face, and lips 55 extending inwardly from the lower edges of side flanges 53 with the lips being generally parallel to upper face 51. Lips 55 terminate short of one another and define a slot 57 therebetween. An irregularly-shaped opening 59 is provided in the upper surface of guide member 49. A sheet metal speed nut, as generally indicated at 61, is retained within guide 49, this nut being threadably engagable with a respective vise screw 33. Specifically, nut 61 is a generally channel-shaped member formed of relatively thick sheet metal or the like having a central web 63 and side flanges 65. A central opening 67 is provided in web 63 and the portions of the web surrounding opening 67 are bent out of the plane of the web thereby to threadably engage vise screw rod 33. As best shown in FIG. 5 and as indicated at 69, the ends of flanges 65 extend down below web 63 and these web extensions are received in openings 71 provided in the bottom flanges 55 of guide member 49. It will be appreciated that nut 61 may be dropped down through opening 59 in the upper surface 51 of the guide member so that web extensions 69 are received in openings 71 and so that the bottom edge of the web 63 of the nut bears on the upper faces of flanges 55. Additionally, the upper portion of the nut is engagable with the portions of the upper surface 51 of the guide defining opening 59. In this manner, the nut is positively restrained against fore and aft movement with respect to guide 49 and is further restrained against side-to-side (lateral) movement with respect to the guide.

As best shown in FIG. 3, opening 59 in the upper face 51 of guide member 49 further includes an aperture 73 for purposes as will appear. As shown in FIG. 5, an upwardly projecting dimple, as indicated at 75, is provided in upper face 51 of the guide member. This dimple cooperates with flanges 77 of its respective end frame member 9R or 9L which extend downwardly within the end frame member so as to define longitudinal slot 17 in the upper face of the end frame member. End frame members 9R, 9L each have inwardly projecting, horizontal flanges 78 extending the length of the end frame members for engaging and supporting the lower surfaces (i.e., lips 55) of guide 49. Dimple 75 on the upper face of the guide is disposed so as to be only slightly below the lower edges of flanges 77 of end frame member 9L with the guide member 49 being slidably supported on flanges 78. Thus, dimple 75 prevents substantial vertical movement of each guide 49 with respect to its end frame member. It will be further appreciated that the width of guide 49 in such that it is slidably received between the inner and outer walls of its respective end frame member 9R or 9L and thus the guide is also constrained against substantial lateral movement with respect to its end frame member. It will further be appreciated that the inner edges of lower flanges 78 of the end frame members are spaced apart from one another a distance somewhat greater than the width of nut 61 so that the flanges do not interfere with the lower portions of the nut flange extension 69 extending down through openings 71 in the guide 49 as the guide is moved axially within its end frame member.

Movable vise jaw 25 is supported on end frame members 9R and 9L by means of a pair of support fittings 79 engagable with the lower face of the movable jaw. As best shown in FIG. 3, each support bracket 79 is generally a flattened U-shaped bracket having a central web 80 and side flanges 81 extending upwardly and outwardly therefrom for engagement with the lower face of the movable vise jaw. A headed coupling pin, as indicated at 82, extends down through an opening provided in web 80 of support bracket 79, this coupling pin preferably being welded to the support bracket. As shown best in FIG. 5, the lower end of pin 82 is received in opening 73 in the upper face 51 of guide 49 thereby to couple support bracket 79 to guide member 49 as the latter is moved in axial direction with respect to vise screw 33. A washer 83 is received on pin 82 and is disposed below the lower edges of flanges 77 of the end frame member thereby to prevent vertical movement of the support bracket relative to the end frame member. A push nut 85 is installed on pin 82 to hold washer 83 at its desired position on the pin. A flange 87 is bent downwardly from the rear end portion of center web 80 support bracket 79 with this flange 87 being received between flanges 77 of the end frame member within slot 17 thereby to maintain axial alignment between support bracket 79 and its respective end frame member 9R, 9L.

An upwardly extending stud, as indicated at 89, is secured (e.g., welded) to the upper face of web 80 of support bracket 79 with this stud 89 being located rearwardly of pin 82. As shown in FIG. 3, a pair of elongate slots 91 in provided in movable vise jaw 25 with these slots extending in transverse or lateral direction with respect to the axis of vise screws 33. As shown in FIG. 5, with movable vise jaw 25 supported on support brackets 79, studs 89 are each received in a respective slot 91. It will be appreciated that with stud 89 received in elongate slots 91, this pin-and-slot arrangement enables movable vise jaw 25 to be angled with respect to stationary vise jaw 23 (see FIG. 2) without binding and that it accommodates an effective change of length between the attachment points of the movable vise jaw and the vise jaws 33 as the movable vise jaw is angled.

As indicated generally at 93, means is provided at each side of movable vise jaw 25 for holding the front or inner edge of the vise jaw horizontal with respect to frame 3 thereby to eliminate any tendency of the inner edge of vise jaw to move up or down upon clamping a work piece between movable vise jaw and the stationary vise jaw. A shown best in FIG. 5, this holddown means 93 comprises a headed pin 95 received in slot 17 of a respective end frame member 9R, 9L with its head below the lower edges of flanges 77 of the end frame member. Pin 95 includes a shank 97 having a circular flange 98 intermediate the headed and the free ends of the pin. The upper end of shank 97 is received in a counterbored hole 99 adjacent the inner edge of the movable vise jaw. A screw 101 and a washer 103 are inserted into the counter bored hole in the movable vise jaw from above and is threaded into shank 97. In this manner, flange 98 is drawn upwardly into firm contact with the bottom of the movable jaw and pin 95 is held rigid with respect to the movable jaw. It will be appreciated that upon a force being applied to the movable jaw which tends to rotate the movable vise jaw in counterclockwise direction (as viewed in FIG. 5) that the headed pin will engage the bottom edges of flanges 77 of the end frame members thereby to hold the movable vise jaw against rotation. Upon applying a downward force on the inner edge of the movable vise jaw which tends to rotate the vise jaw in clockwise direction (as shown in FIG. 5), support fittings 79 firmly support the movable jaw against downward movement of the movable jaw. It will be further appreciated that the diameter of shank 97 of pin 95 is somewhat less than the width of slot 17 so that the movable jaw 25 together with headed pins 95 carried thereby are free to move laterally a limited amount within slots 17 in the end frame members for purposes as will appear.

It will be appreciated that during assembly of the workbench of the present invention guides 49 may be inserted within their respective end frame members 9R, 9L from the rear thereof and once the guide members are slidably inserted therein, a tab 105 (see FIG. 5) provided on the end frame members may be bent inwardly thereby to block withdrawal of the guide members out of the end frame members.

Referring now to FIGS. 1, 3 and 6, the twist lock leg attachment sockets 11 are each shown to comprise generally C-shaped, one-piece bracket formed of sheet metal or the like rigidly secured (e.g., welded) to the outer face of end frame members 9R and 9L. Each of the leg sockets 11 has a central portion 107 disposed against the outerface of its end frame member and having an upper flange 109 and a lower flange 111. The upper flange 109 has a socket 112 formed therein for receiving the upper end of its respective pipe leg 13 thereby to prevent further upward axial movement of the pipe leg and to prevent lateral movement of the pipe leg in any direction. The lower bracket has an opening 113 therethrough for receiving the pipe leg and permitting the upper end of the pipe leg to be socketed in socket 112 provided in the upper bracket. It will be appreciated that lower bracket 111 extends out from frame 3 a distance somewhat greater than the upper bracket 109 and that the sockets are mounted on frame 3 at an angle with respect to the vertical so that legs 13 extend downwardly and outwardly from the frame whereby the footprint of vise 1 (i.e., the area defined by the bottoms of the legs) is substantially greater than the area defined by frame 3 thereby to increase the stability of workbench 1.

As noted above, sockets 11 include twist lock means for the ready securement of legs 13 in the sockets. This twist lock securement means includes a roll pin 115 which extends diametrically through its respective leg at the upper end thereof with the ends of the pin extending out beyond opposite sides of the leg. Notches 116 and 117 are provided in the lower leg bracket 111 of each socket 11 on opposite sides thereof of opening 113 (see FIG. 7). A downwardly extending detent 118 is provided in the upper face of the lower bracket angularly offset from the notches 116 and 117. Pin 115 is located from the upper end of its respective pipe leg 13 so that with the upper end of the pipe leg inserted through opening 113 in the lower bracket 111 and with the upper end of the leg socketed in its socket 112 provided in the upper bracket, the ends of pin 115 will pass through notches 116 and 117 and will be disposed proximate the upper or inner face of the lower bracket 111. Thus, upon twisting leg 13 in such direction as to rotate the end of pin 113 away from notch 116 toward detent 118, the pin will exert a camming force on the bracket which tends to spring the upper and lower brackets 109 and 111 away from one another thus applying a resilient, compressive load on the portion of leg 13 between the upper and lower brackets. Upon the end of pin 115 coming into register with detent 118, the upper and lower brackets 109 and 111 will be permitted to spring back toward one another slightly thereby positively holding the pin in the detent. In this manner, the legs are rigidly and securely held or locked in sockets 111 and thus the workbench is rigidly and solidly supported on the pipe legs. Of course, to remove the legs, the legs merely need be rotated in the opposite direction so that the ends of pin 115 are moved out of detent 118 and into register with notches 116 and 117 whereby the legs may be withdrawn from the sockets.

Figure 2:
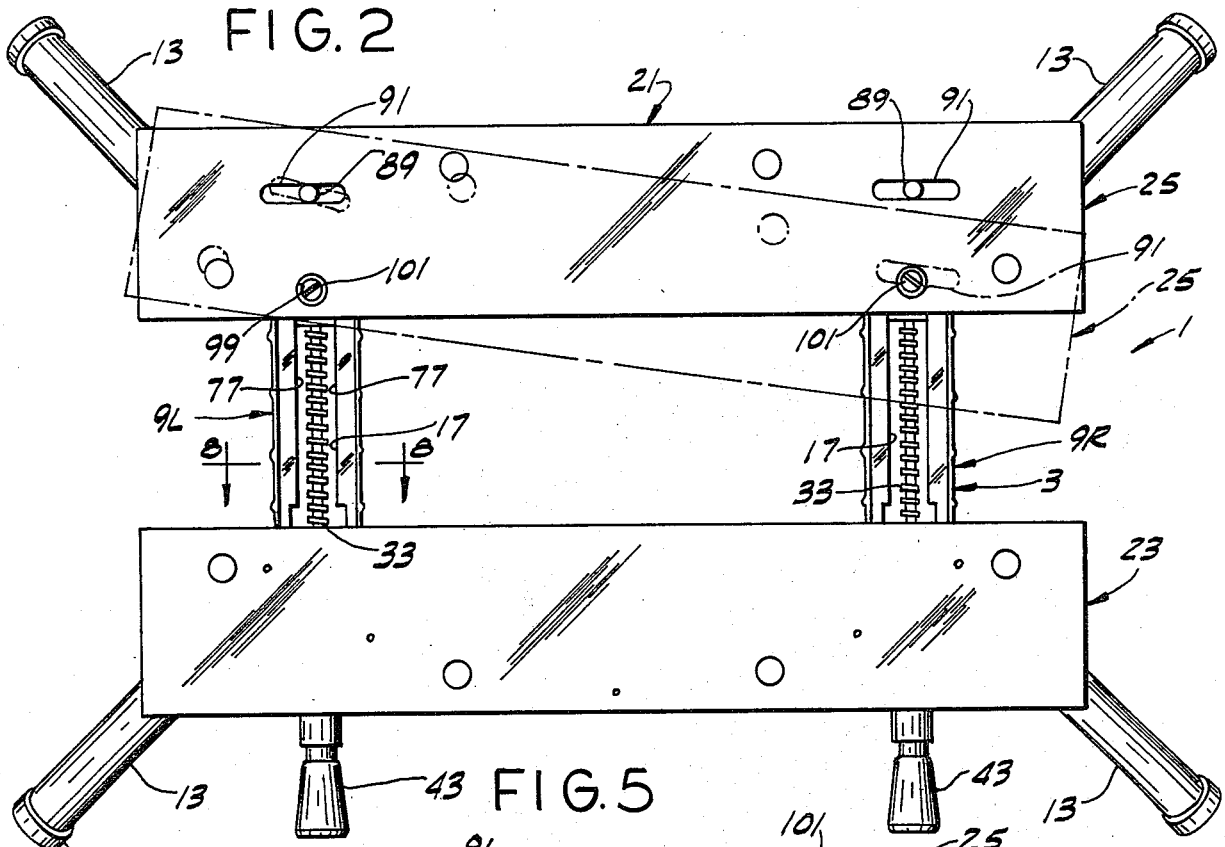
FIG. 2 is a top plan view of the workbench shown in FIG. 1 with the rear or movable jaw of the combination workbench top/vise in its fully opened position in which the movable and fixed jaws are generally parallel to one another, and in which the movable jaw is angled with respect to the fixed jaw, the jaw being shown (in phantom) in an intermediate, angled position.

As best shown in FIGS. 2 and 3, a plurality of holes is provided in both the stationary and movable vise jaws 23 and 25 for receiving work holding members or dogs 123 which may be selectively positioned in any of the holes. Work holding members 123 may, of course, be used to grip various irregular or regular shaped work pieces (not shown).

Figure 9:
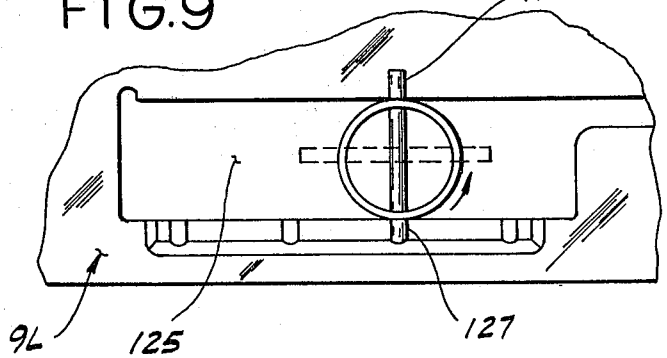
FIG. 9 is a view taken along line 9—9 of FIG. 8.
Figure 8:
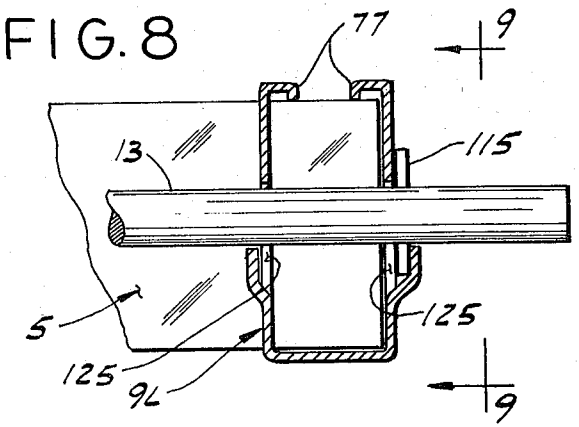
FIG. 8 (sheet 4) is a vertical cross sectional view of the lefthand side frame taken along line 8—8 of FIG. 2 illustrating how the pipe legs are securely stowed in the frame weldment.

Further in accordance with this invention, openings as indicated generally at 125, are provided in each of the end frame members 9R, 9L below the level of vise screws 33. The length of these openings 125 from front to rear of frame 3 is sufficient such that the four legs 13, when removed from the twist lock sockets 11, may be inserted in the openings 125 and thus is stored within the frame. The portions of the end frame members defining openings 125 have detent recesses 127 formed therein cooperable with pins 115 carried by legs 13 thereby to positively hold the legs in the openings. Further, legs 13 may have elastomeric feet 129 applied to their lower ends so as to hold the workbench against sliding. As shown in FIG. 9, pipe legs 13 may be inserted into openings 125 of end frame members 9R, 9L such that the top and bottom ends of the legs protrude out beyond each of the frame members. With pin 115 carried by legs 13 positioned as shown in FIG. 8, the leg is rotated approximately one-quarter term from the insert position (as shown in phantom in FIG. 9) to a lock position (as shown in solid lines in FIG. 9) in which pin 115 cooperates with detent recesses 127 to lock the leg relative to the end frame member against fore and aft movement. Of course, to release the leg, it is merely twisted in the opposite direction to its insert position and slid endwise out of openings 125.

As heretofore described, support bracket 79, the manner in which pin 82 is received in aperture 73 in guide 49, and the pin-and-slot connection of pin 89 is elongate slot 91 of movable vise jaw 25 permits angular movement of the movable vise jaw relative to stationary vise jaw 23. However, as will be appreciated by those skilled in the art, pin 82 coupling the movable jaw and support bracket 79 to guide 49 may be received in an elongate slot in the upper face 51 of guide 49 rather than in the aperture 73 sized to accommodate pin 82 as shown in FIG. 3. In this alternative construction, pin 82 and the elongate slot (not shown) would constitute a pin-and-slot arrangement permitting angular movement of the movable vise jaw, and accommodating an effective change in length between the attachment points and the vise screws.

It view of the above, it will be seen that the several objects of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

What is claimed is:

1. In a portable workbench comprising a frame, a plurality of legs supporting the frame, a pair of work holding table members carried by said frame, one of said table members being fixed relative to said frame and the other of the table members being movable toward and away from said fixed member, and a pair of vise screws carried by said frame and operatively coupled to said movable table member, said vise screws being operable independently of one another thereby to selectively move said movable table member toward and away from said fixed table member and, upon rotating of one of the vise screws an amount different from the other of the vise scews, to angularly move said movable table member relative to said fixed table member, wherein the improvement comprises: said frame including a front frame member, a back frame member, and a pair of hollow end frame members extending between said front and back frame members, each of said end frame members having a longitudinal slot in the upper face thereof, each of said vise screws being disposed within a respective end frame member and being journalled relative to said front frame member, each of said end frame members having a guide movable axially therewithin, each said guide being threadably coupled with a respective vise screw so as to effect axial sliding movement of the guide within said end frame member upon rotation of said vise screw, a pair of support fittings engagable with the lower face of said movable table member, each of said support fittings being positioned to bear against the upper surface of a respective said end frame member, a pair of elongate slots in said movable table member, each said elongate slot extending in generally lateral direction with respect to said movable table member and being disposed proximate a respective end frame member, means extending through said slot in the upper face of said end frame members interconnecting said support fitting and said guide for the transfer of force from said vise screw to said movable table member, and a pin carried by each said support fitting received in a respective said elongate slot in said movable table member for transmitting loads substantially in the direction of the longitudinal axes of said vise screws between said support fittings and said movable table member and for permitting said movable table member to move angularly with respect to said fixed table member upon rotating said vise screws different amounts, and means secured to said movable table member extending through said slots in the upper faces of said end frame members engagable with said end frame members for holding said movable table in a desired horizontal position, each said end frame member having inner and outer walls and guide surfaces spaced above and below said guide, said guide being an elongate member sized to be slidably received between said sidewalls of its respective end frame member and between said guide surfaces above and below said guide so as to be freely slidably movable substantially without lateral or vertical movement with respect to its end frame member.

2. In a portable workbench as set forth in claim 1 wherein each said guide further comprises a nut threadably engagable with said vise screw, said guide holding said nut against substantial axial and rotational movement relative to said guide.

3. In a portable workbench comprising a frame, a plurality of legs supporting the frame, a pair of work holding table members carried by said frame, one of said table members being fixed relative to said frame and the other of the table members being movable toward and away from said fixed member, and a pair of vise screws carried by said frame and operatively coupled to said movable table member, said vise screws being operable independently of one another thereby to selectively move said movable table member toward and away from said fixed table member and, upon rotating of one of the vise screws an amount different from the other of the vise screws, to angularly move said movable table member relative to said fixed table member, wherein the improvement comprises: said frame including a front frame member, a back frame member, and a pair of hollow end frame members extending between said front and back frame members, each of said end frame members having a longitudinal slot in the upper face thereof, each of said vise screws being disposed within a respective end frame member and being journalled relative to said front frame member, each of said end frame members having a guide movable axially therewithin, each said guide being threadably coupled with a respective vise screw and having a sliding fit within its respective end frame member and being constrained against substantial vertical and lateral movement with respect to its end frame member so as to effect axial sliding movement of the guide within said end frame member upon rotation of said vise screw, a pair of support fittings engagable with the lower face of said movable table member, each of said support fittings being positioned to bear against the upper surface of a respective said end frame member, a pair of elongate slots in said movable table member, each said elongate slot extending in generally lateral direction with respect to said movable table member and being disposed proximate a respective end frame member, means extending through said slot in the upper face of said end frame members interconnecting said support fitting and said guide for the transfer of force from said vise screw to said movable table member, and a pin carried by each said support fitting received in a respective said elongate slot in said movable table member for transmitting loads substantially in the direction of the longitudinal axes of said vise screws between said support fittings and said movable table member and for permitting said movable table member to move angularly with respect to said fixed table member upon rotating said vise screws different amounts, and means secured to said movable table member extending through said slots in the upper faces of said end frame members engagable with said end frame members for holding said movable table in a desired horizontal position, said guide further comprising a nut threadably engagable with said vise screw, said guide holding said nut against substantial axial and rotational movement relative to said guide, wherein said nut is a U-shaped member having a central web and flanges at the outer end of the web, the latter having an opening therethrough for reception of said vise screw, the portion of said web defining said opening threadably engaging said vise screw.

4. In a portable workbench as set forth in claim 3 wherein said nut is made of sheet metal and wherein portions of said web defining said hole being bent out of the plane of said web so as to threadably engage the threads of said vise screw.

5. In a portable workbench as set forth in claim 3 wherein said nut is held captive within said guide, the latter having an aperture in its upper face adjacent said nut, said interconnecting means including a pin extending down from said support fitting through slot in said end frame member and being received within said aperture in said guide for the transfer of force between said vise screw and said movable table member, said pin being rotatable with respect to said guide thereby to permit said movable table member to move angularly with respect to said guide.

6. In a portable workbench as set forth in claim 4 wherein said guide is hollow and has a first opening in its upper portion through which said nut may be inserted into said guide and other openings in its lower portion generally opposite said first opening, the bottoms of said nut flanges extending down beyond said nut web with these flange being received in said other openings of said guide, the bottom of said nut web being engagable with said guide thereby to prevent further downward movement of said nut relative to said guide, the nut being of sufficient length so that with the bottom of said web in engagement with the bottom of the guide, a portion of the nut is simultaneously engagable with the upper and lower portions of the guide thereby to substantially prevent relative axial, lateral, and rotational movement between the nut and the guide.

7. In a portable workbench as set forth in claim 5 wherein said support fitting has means cooperable with said upper slot of said end frame member for holding said support fitting in a desired relation with respect to said end frame member as the movable table member is moved toward and away from said fixed table member.

8. In a portable workbench as set forth in claim 7 wherein the upper portion of said guide is spaced below the upper surface of said end frame member, said guide having means projecting above the upper face of said guide for engagement with said end frame member thereby to at least partially constrain the guide against vertical movement relative to the end frame member.

9. In a portable workbench as set forth in claim 5 wherein said interconnecting pin has means thereon between the upper portion of the guide and the under surface of the upper portion of the end frame member for holding the support fitting down on the end frame member.

10. In a portable workbench as set forth in claim 1 wherein said movable table member includes a hole therein, and wherein said means for holding said movable table member in desired horizontal position comprises a headed member having a head disposed within said end frame member between the upper face of said guide and said end frame member and a stem extending up from the head through said upper slot of said end frame member and being received in said hole in said movable table member, said stem being secured to said movable table member, said stem having a flange thereon engagable with the underside of said movable table member, said guide supporting the movable table member against downward movement with respect to said end frame member and said head in engagement with said guide supporting said movable table member against upward movement.

11. A portable workbench as set forth in claim 1 wherein said frame includes a plurality of sockets, one for each of said legs, for removably securing said legs to said frame, each of said legs and its respective socket including quick-acting twist lock means for securely locking said legs in said sockets.

12. In a portable workbench comprising a frame, a plurality of legs supporting the frame, a pair of work holding table members carried by said frame, one of said table members being fixed relative to said frame and the other of the table members being movable toward and away from said fixed member, and a pair of vise screws carried by said frame and operatively coupled to said movable table member, said vise screws being operable independently of one another thereby to selectively move said movable table member toward and away from said fixed table member and, upon rotating of one of the vise screws an amount different from the other of the vise screws, to angularly move said movable table member relative to said fixed table member, wherein the improvement comprises: said frame including a front frame member, a back frame member, and a pair of hollow end frame members extending between said front and back frame members, each of said end frame members having a longitudinal slot in the upper face thereof, each of said vise screws being disposed within a respective end frame member and being journalled relative to said front frame member, each of said end frame members having a guide movable axially therewithin, each said guide being threadably coupled with a respective vise screw and having a sliding fit within its respective end frame member and being constrained against substantial vertical and lateral movement with respect to its end frame member so as to effect axial sliding movement of the guide within said end frame member upon rotation of said vise screw, a pair of support fittings engagable with the lower face of said movable table member, each of said support fittings being positioned to bear against the upper surface of a respective said end frame member, a pair of elongate slots in said movable table member, each said elongate slot extending in generally lateral direction with respect to said movable table member and being disposed proximate a respective end frame member, means extending through said slot in the upper face of said end frame members interconnecting said support fitting and said guide for the transfer of force from said vise screw to said movable table member, and a pin carried by each said support fitting received in a respective said elongate slot in said movable table member for transmitting loads substantially in the direction of the longitudinal axes of said vise screws between said support fittings and said movable table member and for permitting said movable table member to move angularly with respect to said fixed table member upon rotating said vise screws different amounts, and means secured to said movable table member extending through said slots in the upper faces of said end frame members engagable with said end frame members for holding said movable table in a desired horizontal position, said frame including a plurality of sockets, one for each of said legs, for removably securing said legs to said frame, each of said sockets including an upper portion for engagement with the upper end of its respective said leg and a lower portion spaced from the upper portion, the lower portion having an opening therethrough for reception of the leg into the socket, said pipe leg having means projecting outwardly therefrom, said projection means being spaced from the end of the pipe leg so as to be engagable with an upper surface of said lower portion when said leg is in its inserted position within said socket, said lower portion having notch means therein cooperable with said projection means thereby to permit the upper portion of said leg to be inserted in and removed from said socket, said upper surface of the lower portion of the socket being cammingly engagable with said projection means upon rotation of the leg relative to the socket thereby to wedgingly lock the leg with respect to the socket.

13. In a portable workbench as set forth in claim 12 further including detent means in said lower portion of said socket engagable with said projection means upon rotating of said leg relative to said socket thereby to resiliently hold said leg against further rotation with respect to said socket.

14. In a portable workbench as set forth in claim 12 wherein said socket is a one-piece, generally C-shaped member of resilient sheet metal, said upper and lower portions being resiliently forced apart upon rotating said legs relative to said socket and upon said projection means cammingly engaging said upper surface of said lower socket portion.

15. In a portable workbench as set forth in claim 12 wherein said projection means is a pin extending radially out from said leg.

16. A portable workbench comprising a frame, a plurality of pipe legs, a plurality of sockets carried by the frame, one socket for each of said pipe legs, and quick-acting, twist lock means for locking said legs in said sockets thereby to securely lock each leg securely to the frame and to solidly support the frame and for selectively unlocking the legs relative to the frame for disassembly of the workbench, each of said sockets including an upper portion receiving the upper end of a respective pipe leg and a lower portion spaced from the upper portion, the lower portion having an opening therethrough for receiving the upper end of its respective pipe leg, each of said pipe legs having means projecting outwardly therefrom, said lower portion having notch means therein cooperable with said projection means thereby to permit the upper end of pipe leg to be inserted in and removed from said socket, said projection means being spaced from the upper end of the pipe leg so as to be engagable with a surface of said lower portion facing said upper portion when said leg is inserted in said socket, said surface of said lower portion being cammingly engagable by said projection means upon twisting of said pipe leg thereby to lock said leg in position within said socket, said socket being a one-piece, generally C-shaped member of resilient sheet metal, said upper and lower portions being resiliently forced apart upon rotating said legs relative to said socket and upon said projection means cammingly engaging said upper surface of said lower socket portion.

17. A portable workbench as set forth in claim 16 further comprising detent means provided on said lower portion, said detent means being spaced angularly with respect to said notch means and being cooperable with said projection means on said leg so as to engage said projection means and to resiliently hold said leg against rotation.

18. A portable workbench as set forth in claim 16 wherein said projection means is a pin extending radially out from said leg.

* * * * *